United States Patent [19]

Costa Bastart

[11] 4,391,463

[45] Jul. 5, 1983

[54] DOOR CATCH

[76] Inventor: Enrique Costa Bastart, Calle Mayor de Gracia, 213, Barcelona 13, Spain

[21] Appl. No.: 269,948

[22] Filed: Jun. 3, 1981

[30] Foreign Application Priority Data

Jun. 16, 1980 [ES] Spain ..... 251422[U]

[51] Int. Cl.[3] ..... E05C 17/32

[52] U.S. Cl. ..... 292/263

[58] Field of Search ..... 70/93; 292/262, 263

[56] References Cited

U.S. PATENT DOCUMENTS 3,924,886 12/1975 Markovitch ..... 292/263

4,120,523 10/1978 Fayos ..... 292/268

*Primary Examiner*—Richard E. Moore

*Attorney, Agent, or Firm*—Steinberg & Raskin

[57] ABSTRACT

A door catch which is releasable from inside or outside includes a staple projecting from the door and a caliper (two mutually pivoted levers) having at its free end a hook for engaging the staple. A plate is slidable and rockable relative to the door frame. The inner end of the caliper is pivotally mounted on the door frame. With the caliper folded flat against the frame, the hook is not disengageable for disengagement, the folded caliper must be pivoted out until the hook is spaced from the lip of the staple. This can be achieved manually from inside. If the door is partly opened without disengagement, the caliper opens and the slidable plate can be slid from outside, so that on closing the door a lug on the staple rocks the plate, causing a lug to abut the (closed) caliper and pivot it sufficiently to enable disengagement.

8 Claims, 8 Drawing Figures

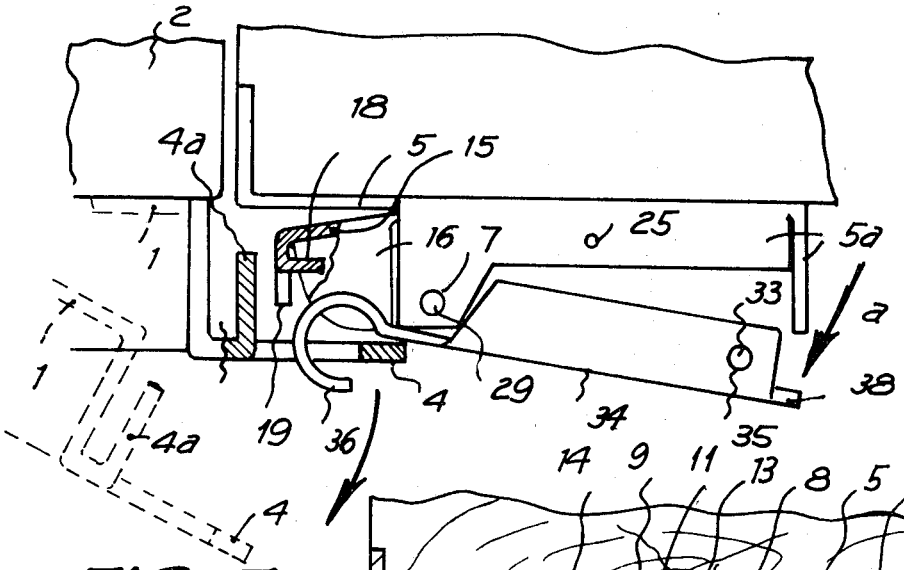
FIG. 5
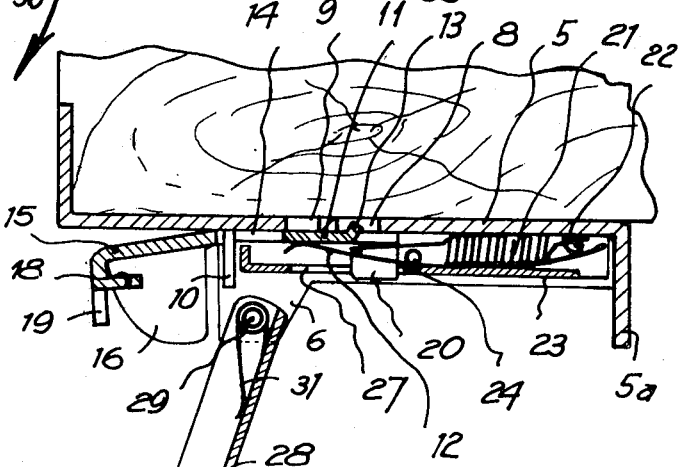
FIG. 6
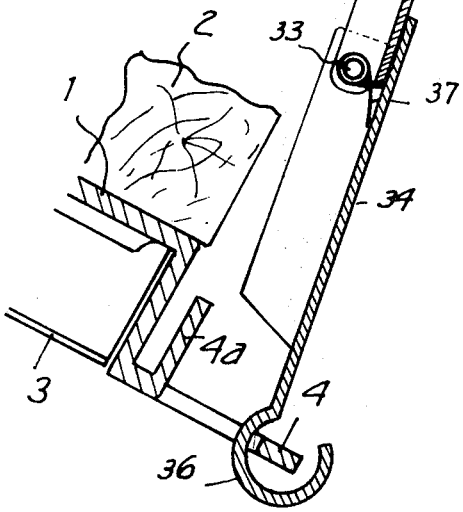

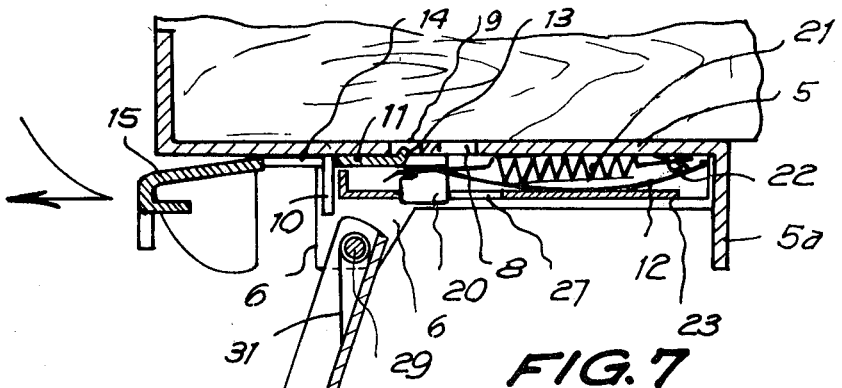
FIG. 7
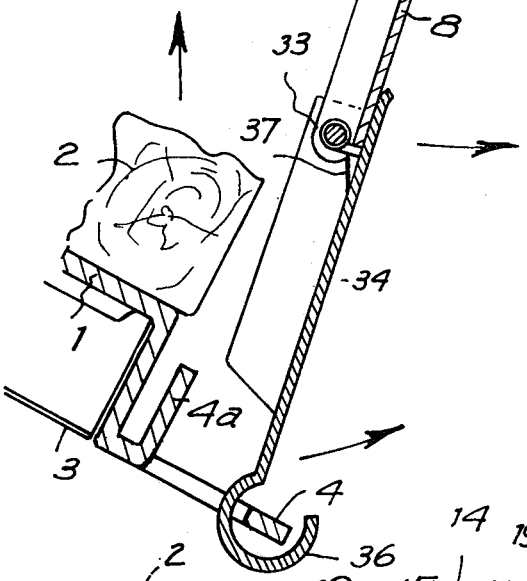
FIG. 8
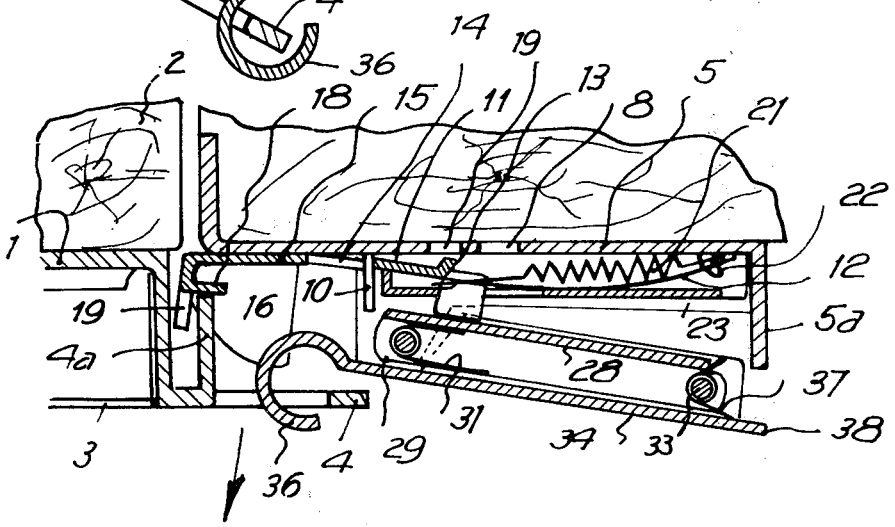

DOOR CATCH

BACKGROUND OF THE INVENTION

The present invention relates to a door catch.

The present applicant is the proprietor of an earlier Spanish Utility Model No. 246,185, which relates to a door catch by means of which the opening of a door can be automatically restricted until a release latch is operated. This previous model introduced some significant innovations in the design of door catches.

Generally speaking, the door catch according to Utility Model No. 246,185 consists of a staple or eye mounted on the edge of the door leaf and adapted to be automatically engaged by a hook formed at the end of a caliper which is adapted to open and close freely. The caliper linkage is articulated, at the opposite end to that carrying the hook, on a support mounted slidably on the door frame. The sliding support has stable locking and release positions. The caliper can be released manually from the inside while the door is closed, and can also be released from the outside when the door is ajar, by pushing the sliding support on which the caliper is articulated and placing it in a position such that the hook can be released from the staple after the door has been closed.

The door catch forming the object of the present model is based on the previous model, but has introduced substantial improvements to it, particularly with regard to the mode of releasing the catch from the outside of the door. Furthermore, a door catch according to the invention may use a staple fixed to the door which has less protrusions which might hurt a person manipulating the door.

SUMMARY OF THE INVENTION

According to the present invention there is provided a catch for holding a door closed, comprising two complementary mutually engageable latching means, and respective mounting means for mounting said latching means to respective ones of a door and an element adjacent the door so that the latching means are mutually engageable when the door is closed; a first one of said mounting means comprising an extendible link and means for articulating said link to the door or element whereby in use the door is partially inwardly openable to a predetermined extent with the latching means mutually engaged; the link being displaceable between releasable and locked configurations in which the latching means respectively are and are not mutually disengageable by opening the door; said first mounting means also including an actuating element which is displaceable between actuating and non-actuating configurations, in the former of which it is actuable to displace the link to its releasable configuration, said actuating element being constructed and arranged to be displaceable in use to its actuating configuration from outside the partially open door, and to be actuated by closure of the door, whereby the door is freely inwardly openable with disengagement of the latching means.

Preferably, the actuating element has at least one claw adapted to be received in openings spaced apart longitudinally in the direction of its displacement and it is also able to rock slightly against the action of a spring which tends to hold it in the position of rest; in this rocked position it pushes the extendible link towards its releasable configuration.

The actuating element may, when in its actuating configuration, be urged by a projecting lug on the other latching means to rock so as to displace the extendible linkage to its releasable configuration while at the same time the lug prevents the actuating element from being returned to its non-actuating configuration (whither it may be resiliently urged).

Preferably, the actuating element is slidable and rockable on a support fixed to the door or door frame.

The actuating element may have projecting lugs for manipulation from the outside when the door is open, to move it to its actuating configuration.

BRIEF DESCRIPTION OF THE DRAWINGS

A preferred embodiment of the invention will now be described with reference to the accompanying drawings in which:

FIG. 5 is a plan view, partly in section, showing the door catch being moved, from the interior side of the door, to a releasable configuration;

FIG. 6 is a sectional plan view showing the door ajar with the catch preventing further opening and still in a locking configuration;

FIG. 7 is a similar view to FIG. 6, but with the sliding plate displaced longitudinally to render the catch releasable from outside;

FIG. 8 is a sectional plan view showing the door closed from the configuration of FIG. 7.

DESCRIPTION OF THE PREFERRED EMBODIMENT

Figure 1:
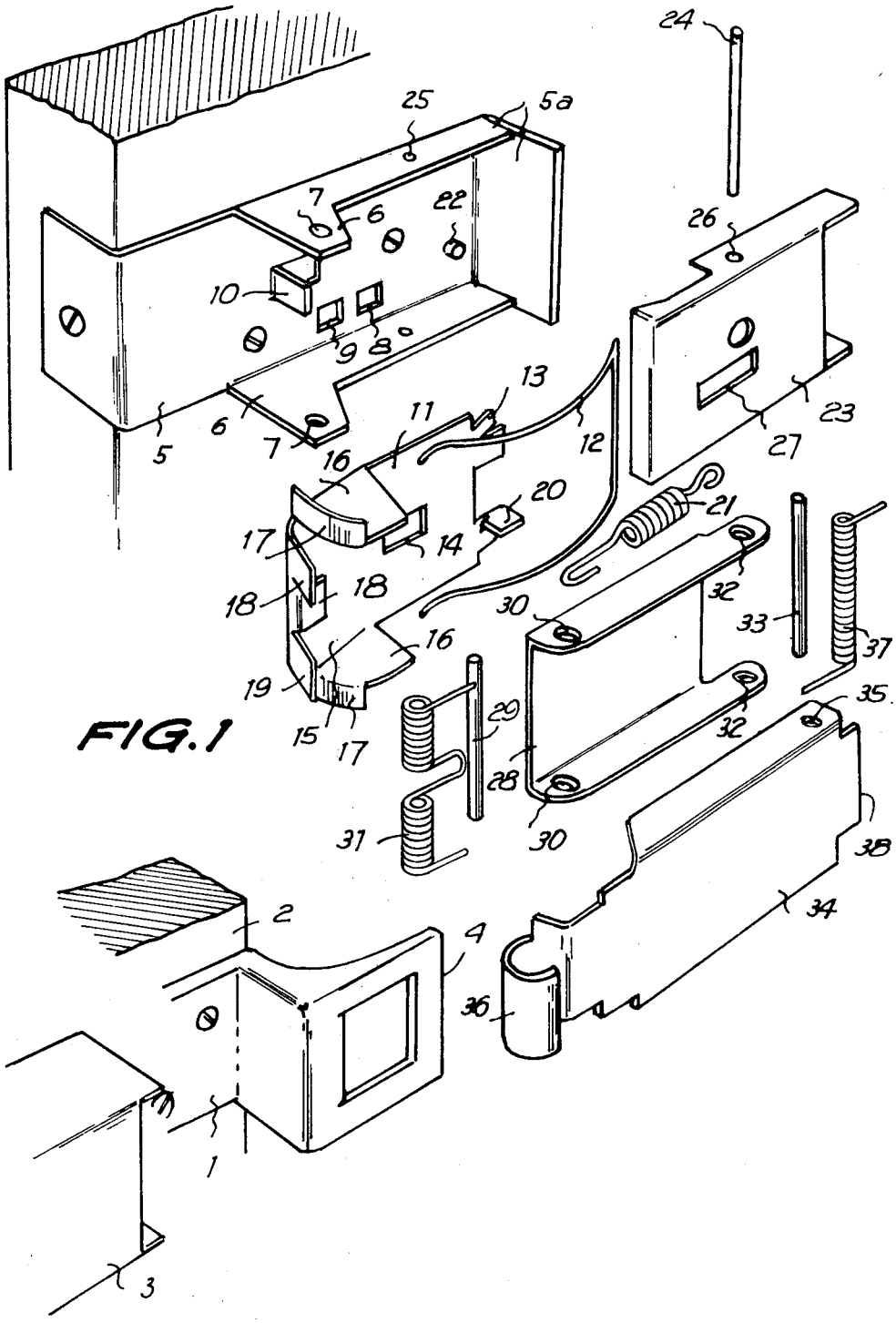
FIG. 1 is an exploded view in perspective of a door and frame bearing a catch assembly embodying the invention.

The illustrated door catch includes a plate 1 attached to a door 2 adjacent its side edge. The plate 1 has a decorative and protective cover 3, and a cranked, projecting end portion providing a staple 4 which has a lug **4*a* which extends towards the outer face of the door (see FIG. 4**).

On the fixed door frame **2*a* is mounted a support plate 5 having inwardly projecting lugs 6 provided with apertures 7** the purpose of which will be explained later on. ('Inwardly' and 'outwardly' are defined assuming the door to open inwardly).

Figure 2:
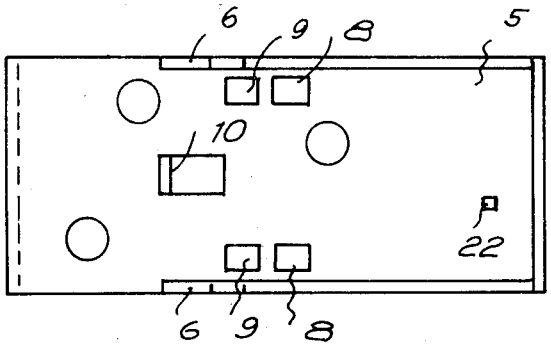
FIG. 2 is a view in elevation of the support plate of the catch seen in FIG. 1.
Figure 3:
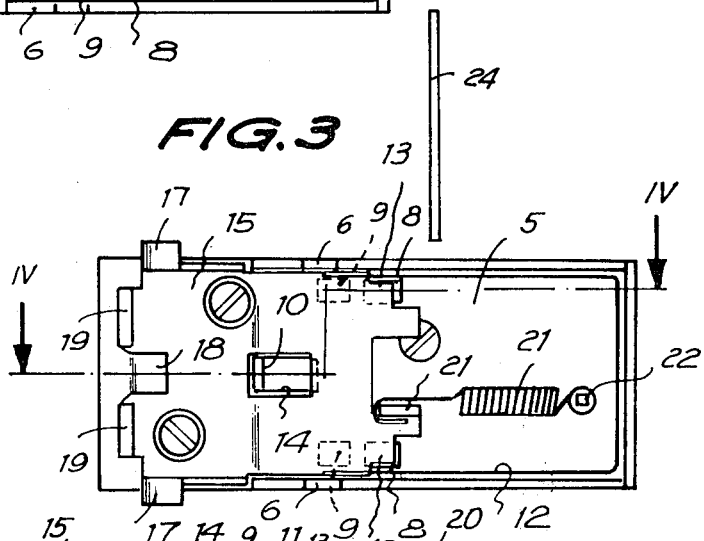
FIG. 3 is a view similar to that of FIG. 2 with the sliding plate mounted on the support plate.

The support plate 5 has portions of its edges **5*a* folded over to form a box, with two pairs of spaced apertures 8 and 9 and a raised lug 10 in its base (see FIG. 2**).

On the plate 5 is mounted a sliding plate 11, held in contact by a spring 12 so that it can slide with friction. The plate 11 is provided with bent-over claws 13 intended to be introduced selectively into the apertures 8 and 9. This sliding plate has an aperture 14 for the lug 10, which limits the displacement of the sliding plate.

The sliding plate 11 has a flat portion 15 extending towards the door 2, and which is inclined inwardly relative to the remainder of the plate so as to provide a vertex between the two portions allowing slight rocking of the plate, against the action of the spring 12.

Lateral lugs 16 extend inwardly from the portion 15 and have flanges 17 in order to facilitate their manipulation. The region of the plate 11 closest to the door 2 has a lug 18 folded over away from the door 2, and lying between two other inward lugs 19 at right angles to it.

The sliding plate 11 has another inwardly projecting lug 20 at the opposite edge region, on which is fastened one end of a spring 21 whose opposite end is fastened on a pivot 22 projecting from the support plate 5.

On the plate 5 is mounted a decorative and protective cover 23, fastened by means of a pin 24 passing through apertures 25 in the flanges 5a of the plate 5 and through apertures 26 in the cover 23. This cover holds the spring 12 compressed. It has a window 27 through which projects the lug 20 of the sliding plate 11.

On the lugs 6 of the support plate 5 is mounted a link 28 in the form of a plate with inwardly extending flanges along its upper and lower edges. The flanges are penetrated by pairs of apertures 30 and 32. The link is articulated about a pin 29 passing through apertures 7 and 30 in the lugs and link respectively. Around this pin 29 is placed a torsion spring 31 which urges it against the fixed support plate 5.

The apertures 32 in the link 28 are for mounting a pivot pin 33 for a top plate 34 provided with apertures 35 (in outwardly extending upper and lower flanges) for the pivot pin and carrying a hook 36 at its end nearer the door, i.e. at the opposite end to the articulation.

A torsion spring 37 is disposed around the pin 33 and urges the top plate 34 in the folded position against the link 28.

The edge of the plate 34 remote from the door is extended by a stub 38 for use in releasing the door catch.

Figure 4:
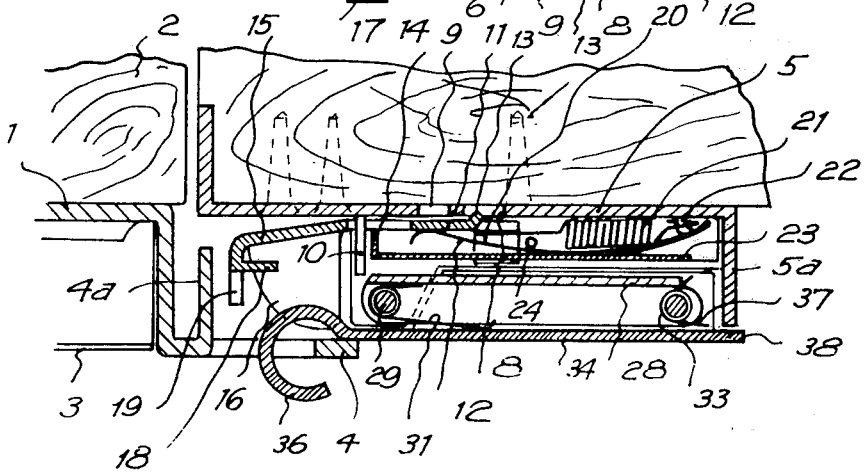
FIG. 4 is a sectional plan view showing the catch and door locked in a closed configuration.

In the closed configuration of the catch, as seen in FIG. 4, the hook 36 is engaged in the staple 4, being maintained there by the action of the springs 31 and 37, which urge the caliper-like linkage or arm formed by the link 28 and the outer plate 34 to remain closed.

In addition, the spring 12 presses the sliding plate 11 against the support plate 5 to increase frictional resistance to its displacement (FIG. 4).

In order to release the door holder it is necessary to pull the stub 38 manually in the direction indicated by the arrow "a" in FIG. 5 while keeping the door closed, so that the hook 36 is separated from the staple 4 to a sufficient extent to enable the door 2 to open without any hindrance (broken lines in FIG. 5).

When the door is opened without the stub 38 being moved in the manner described, the hook 36 and the staple 4 remain in engagement and the linkage formed by the link 28 and the outer plate 34 is unfolded (FIG. 6), limiting the opening of the door.

In this position it is possible to release the door catch from the outside. In order to do this, the flanges 17 of the lugs 16 which are accessible from outside, are manipulated to force the sliding plate 11 to rock slightly on its vertex, against the force of the spring 12, to a sufficient extent for the claws 13 to disengage from the aperture 8. At the same time the lugs 16 are pulled to slide the plate 11 against the tension of the spring 21 in the direction generally towards the door, until the plate 11 rocks back and the claws 13 engage in the apertures 9, whereby this position is held (FIG. 7).

The door catch is now in a releasable configuration but for release to be achieved it is first necessary to close the door 2. Thereby the lug 4a of the staple 4 is caused to press against the lug 18 of the sliding plate 11, thus causing the plate 11 to rock about its vertex sufficiently for the lug 20, which projects through the window 27 of the cover 23, to push against the link 28 and force it to pivot about the pin 29, so that the hook 36 will be freed from the staple 4 and the door will be able to open without difficulty (FIG. 8). The rocking of the plate 11 also disengages the claws 13 from the apertures 9. The position prior to release is maintained owing to the fact that the lug 4a of the staple 4 not only presses against the lug 18 of the sliding plate 11 but is also abutted by the lugs 19 of the plate 11, thus preventing sliding of the latter as is urged resiliently by the spring 21.

When the door is opened, the lug 4a frees the lugs 18 and 19, and the sliding plate 11 returns to its original position.

I claim:

1. A catch for holding a door closed, comprising two complementary mutually engageable latching means, and respective mounting means for mounting said latching means to respective ones of a door and an element adjacent the door so that the latching means are mutually engageable when the door is closed; a first one of said mounting means comprising an extendible link and means for articulating said link to the door or element, whereby in use the door is partially inwardly openable to a predetermined extent with the latching means mutually engaged; the link being displaceable between releasable and locked configurations in which the latching means respectively are and are not mutually disengageable by opening the door; said first mounting means also including an actuating element which is displaceable between actuating and non-actuating configurations, in the former of which it is actuable to displace the link to its releasable configuration, said actuating element being constructed and arranged to be displaceable in use to its actuating configuration from outside the partially open door, and to be actuated by closure of the door, whereby the door is freely inwardly openable with disengagement of the latching means.

2. A catch according to claim 1 wherein said extendible link comprises a caliper linkage having two mutually pivoted levers, one of said levers being adapted to be pivotally mounted to said door or element, and the other bearing the respective latching means.

3. A catch according to claim 2 wherein said actuating element comprises a rockable plate, having an abutment portion disposed so that on rocking said plate when it is in its actuating configuration, said abutment portion urges said caliper linkage to the releasable configuration.

4. A catch according to claim 3 wherein said first mounting means includes a support plate for mounting to the door or support and on which said caliper linkage is pivotally mounted, and said rockable plate is slidable on said support plate between its actuating and non-actuating configurations.

5. Door holder according to claim 3 having resilient means urging the caliper linkage to its locked configuration.

6. A catch according to claim 4 wherein said rockable plate is resiliently urged to its non-actuating configuration, and wherein the latching means mounted via the second mounting means includes an abutment disposed so that in use it abuts the rockable plate in the actuating configuration thereof on closure of the partially open door to actuate the plate and to retain it in the actuating configuration.

7. In a door catch comprising two complementary mutually engageable latching means, and respective mounting means for mounting said latching means to respective ones of a door and an element adjacent the door so that the latching means are mutually engageable when the door is closed, a first one of said mounting means comprising a caliper linkage having inner and outer end portions and an intermediate pivot, one of said latching means being provided at the outer end portion, and means for pivotally mounting said caliper linkage at its inner end portion to the element adjacent the door, whereby in use the door is partially inwardly openable to a predetermined extent with the latching means mutually engaged; said caliper linkage being displaceable between releasable and locked configurations in which the latching means respectively are and are not mutually disengageable, the improvement comprising: a support for mounting to said element, said caliper linkage being pivotally mounted thereto; and a rockable actuating element disposed on the support so as to be slidable thereon between actuable and non-actuable configurations, said actuating element being constructed and arranged so that when in its actuating configuration with the door partially open, closure of the door causes the actuating element to rock and thereby urge the caliper linkage to its releasable configuration.

8. A door catch comprising:

a support plate for mounting to a door frame and having pivot means and two detent means;

a rocking plate slidable on the support plate and having a projecting lug, and detent means selectively engageable with either of the detent means of the support plate to retain the rocking plate respectively in an actuating or a non-actuating position; said plate being shaped to be rockable on the support plate to a configuration in which (a) said detent means are disengageable and (b) said lug is caused to project to a greater extent away from the support plate;

first spring means urging said rocking plate against the support plate, and urging rocking in a sense to engage the detent means;

second spring means urging said rocking plate to slide over the support plate to its non-actuating position;

a first lever pivotally mounted at an inner end portion to the pivot means of the support plate;

a second lever pivotally connected at an inner end portion to the outer end portion of the first lever;

third spring means arranged to urge the first lever against the lug of the rocking plate, and the second lever against the first lever;

hook means at the outer end portion of the second lever;

eye means adapted to be releasably engageable with said hook means and having an inwardly extending abutment;

mounting means for mounting said eye means to the edge portion of a door, so that in use said levers are pivotable about the pivot means of the support plate between configurations in which the hook and eye means respectively are and are not mutually disengageable, and wherein said hook and eye means are mutually engageable with the door shut, and wherein mutual pivoting of said levers and pivoting of said first lever about the support plate allows partial opening of the door with said hook and eye means engaged, whereupon said rocking plate is slidable to its actuating configuration, whereafter on closing the door the abutment on the eye means abuts the rocking plate, causing it to rock, whereby the lug thereof tends to cause the levers to pivot about the pivot means of the support plate to the configuration in which the hook and eye means are disengageable.

* * * * *